United States Patent [19]

Wiebe et al.

[11] Patent Number: 5,000,272

[45] Date of Patent: Mar. 19, 1991

[54] SELF-CONTROLLING DRILL ROD

[76] Inventors: Martin Wiebe, Habichtstrasse 7, D-4320 Hattingen; Heinz Wallusek, Altestrasse 33, D-5804 Herdecke, both of Fed. Rep. of Germany

[21] Appl. No.: 297,046

[22] Filed: Jan. 17, 1989

[30] Foreign Application Priority Data

Jan. 19, 1988 [EP] European Pat. Off. ..... 88100657.1

[51] Int. Cl.[5] ..... E21B 7/04

[52] U.S. Cl. ..... 175/73; 175/48; 175/324; 175/325

[58] Field of Search ..... 175/73, 74, 40, 48, 175/24, 320, 324, 325, 45

[56] References Cited

U.S. PATENT DOCUMENTS

| | | | |
|---|---|---|---|
| 2,316,409 | 4/1943 | Downing | 175/73 |
| 3,005,507 | 10/1961 | Clark, Jr. et al. | 175/324 |
| 3,062,303 | 11/1962 | Schultz | 175/73 X |
| 3,196,959 | 7/1965 | Kammerer | 175/73 |
| 3,595,326 | 7/1971 | Claycomb | 175/73 |
| 4,040,494 | 8/1977 | Kellner | 175/73 X |
| 4,407,374 | 10/1983 | Wallussek et al. | 175/73 X |
| 4,596,293 | 6/1986 | Wallussek et al. | 175/45 |
| 4,947,944 | 8/1990 | Coltman et al. | 175/73 |

FOREIGN PATENT DOCUMENTS

| | | |
|---|---|---|
| 0134467 | 3/1985 | European Pat. Off. . |
| 2016952 | 10/1971 | Fed. Rep. of Germany . |
| 197472 | 8/1967 | U.S.S.R. . |
| 438771 | 1/1975 | U.S.S.R. . |
| 1356969 | 11/1987 | U.S.S.R. . |
| 867025 | 5/1961 | United Kingdom . |

OTHER PUBLICATIONS

*Selbsttatig Steuerndes Zielbohrsystem*, Dipl.-Ing. Volkmar Mertens und Dipl.-Ing. Heinz Wallussek, pp. 819-822.

*Primary Examiner*—Hoang C. Dang
*Attorney, Agent, or Firm*—Reese Taylor

[57] ABSTRACT

For a self-controlling drill rod for rotary boring rods of machine rock drills, comprising an inner drilling shaft adapted to be connected with the boring rods and the boring tool and having a flush channel and a housing mounted on the drilling shaft so as to be rotatable thereabout, control bars capable of swinging out being disposed on the outside of the housing, and the parts of the hydrostatic drives acting on the control bars as well as the control electronics and control electrical system being provided within the housing, whereby the required energy is generated by the rotary motion during the boring operation, the inventive improvement is that an annular space exists between the drilling shaft and the housing having a radial connection with the flush channel of the drilling shaft and being closed off at each end by a rotary check valve keeping out the borehole fluid, and that the annular space serves as a tank for the working fluid of the hydraulic system, said fluid being formed by the drilling shaft fluid.

7 Claims, 2 Drawing Sheets

FIG. 1
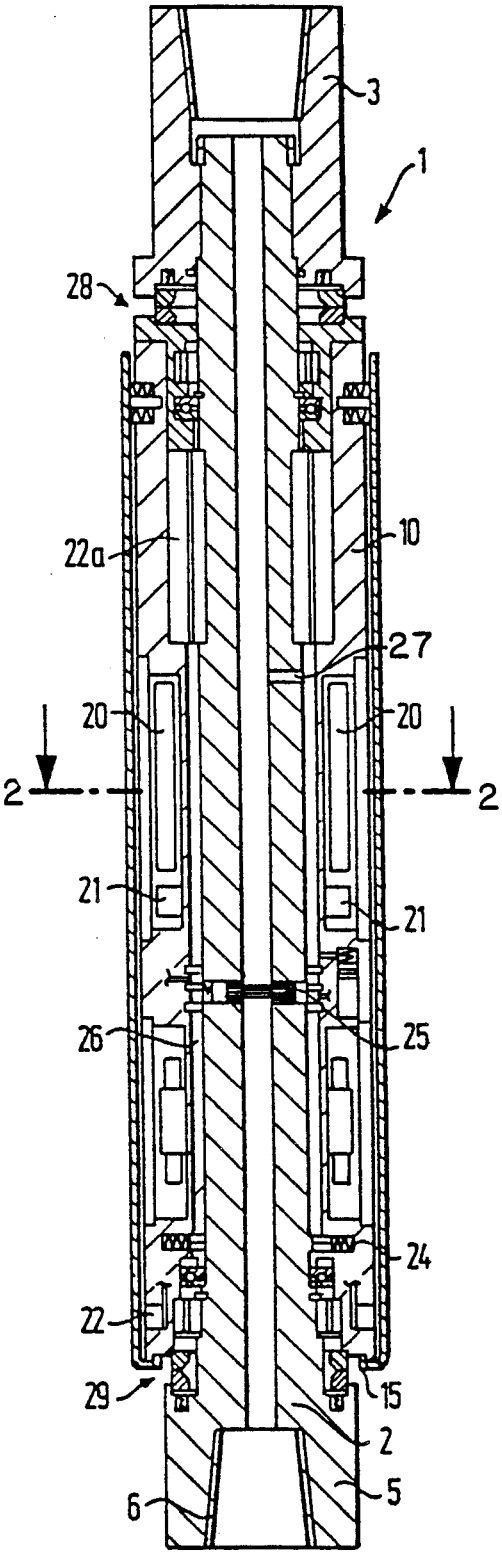
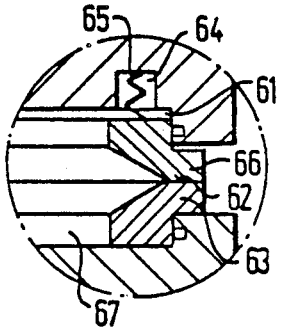
FIG. 4
FIG. 2
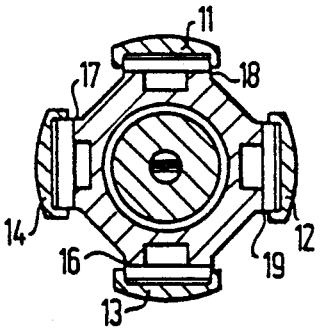

SELF-CONTROLLING DRILL ROD

RELATED PATENT APPLICATIONS

This application claims priority under 35 U.S.C. 119 based on European Application No. 88 10 06 57.1, filed Jan. 19, 1988.

BACKGROUND OF THE INVENTION

The present invention relates to a self-controlling drill rod for rotary boring tools of machine rock tools.

The inventive self-controlling drill rod is disposed behind the boring tool and generally in the vicinity thereof. Its inner drilling shaft is directly connected so as to rotate in particular with the deepest drill rod and with the boring tool. The boring tool used is, for example, a boring head equipped with a plurality of cross roller bits. The self-control therefore works directly behind the free cut of the boring tool, so that each deviation of the boring tool from the predetermined direction of boring is corrected so quickly that the direction of boring virtually coincides with the desired direction. The self-control means required therefor is placed with its various systems in the vertical housing which encloses the drilling shaft. On the outside the housing bears the control bars offset by equal angles of arc and pivoted at one end, which cooperate with the borehole face to apply the necessary correction forces. The housing contains chambers which accommodate the sensors designed as gradometers, the system serving to drive the control bars, which can swing out the control bars individually in accordance with the particular deviations, and the control electronics and possibly special electronics for acting on a measurement/pressure pulse generator which transmits data on the drilling progress via the borehole fluid. The housing also contains the stator of a generator that generates the electrical energy for the electronics and electrical system.

The chambers are generally placed one behind the other in radial projections of the vertical outer body which are placed behind control bars mounted at the end of the housing facing the rods and connected to the path limiter at the end facing the boring tool. This results in a space saving arrangement which allows for rods for borings with relatively small diameters, e.g. of 21.6 cm.

The rotary boring rods with which the inventive self-controlling drill rod is used are generally driven by a drill motor set up outside the boring. Such machine rock drills operating by the rotary drilling method produce borings sunk from the top to the bottom, in which the borehole fluid serves to carry the debris removed from the bottom of the borehole by the boring tool toward the top and out of the boring. This flushing can be performed with water with the inventive apparatus as well if the lifting speed is sufficient in the borehole, but weighted fluids producing an additional lift, which are known in the form of gel or mud having thixotrope properties when weighted, e.g. by bentonite, are also suitable. Since gravity supports the removal of debris from the borehole when drilling from the bottom to the top, the inventive apparatus can also be used for such borings provided drilling fluids are provided, for instance, to cool the bits.

The borehole mud flowing in the area between the boring rods and the borehole face can be used to transmit measured values. Part of the electrical system is then used for the hydraulic control of the pressure pulse generator which is mounted in the shaft and changes the cross-section of the flush channel. However, the hydraulic control of the pulse generator must be provided in the outer body.

Due to the largely miniaturized hydraulics in view of the lack of space in the housing, such self-controlling drill rods make it necessary to place high demands on the cleanness of the hydraulic working fluid and also to protect the mechanical parts, e.g. the bearings of the drilling shaft, which are especially sensitive to the penetration of debris.

The invention assumes a known self-controlling drill rod of the type described at the outset (Glückauf journal 120 (1984) no. 13, pp. 819,822). One of the above-mentioned chambers serves here as a tank for the hydraulic working fluid (consisting of oil) of the hydraulic pumps for the pistons provided behind each control bar in the rods. The pumps constitute the pressure generators of the system and are driven mechanically, e.g. via an eccentric of the drilling shaft. The hydraulic control of the pressure pulse generator necessitates a number of rotary transmission leadthroughs of the drilling shaft in the housing, which are provided with soft seals sealed on the drilling shaft for sealing the working fluid of the hydraulic system pressurized at, e.g., 100 bar. The radial bearings of the drilling shaft are seated in the end of the housing, which are supplemented by an axial bearing disposed behind the radial bearing in the housing on the side facing the boring tool. These drilling shaft bearings are designed as rolling bearings to obtain an easy-running shaft in the housing. The faces of the housing are provided with rotary seals to protect the drilling shaft bearings, separating the bearing lubrication from the borehole mud and relieving the soft seals.

On the one hand, the described construction of these seals is elaborate and susceptible to disturbance due to the great number of their components. On the other hand, the sealing pressure of the rotary seals does not suffice for high pressures of the borehole fluid, as are encountered in the case of deep borings which must be sunk over several hundred or even thousand meters. The rotary bearing rings sealing against one another must be isolated. But even at small depths a lubricant wedge still forms between these rotary seal surfaces rubbing against each other. Even if they are mounted with the greatest care, the drilling shaft and the housing perform radial motions which also act between the rotary seal surfaces sealing against each other and provided with lubricant. This causes extremely fine debris to be drawn out of the borehole fluid into the above-mentioned lubricant wedge. These particles have an abrasive effect on the polished rotary seal surfaces rubbing against each other. This ultimately causes parts of the debris to come between the drilling shaft and the housing. They soon destroy the shaft bearings and also attack the generator, hydraulic pumps and soft seals of the rotary transmission leadthroughs. The damage or destruction of these parts is particularly dangerous because it may cause the oil serving as the working fluid to be lost. The entire amount of oil present is very small, so that even small losses of oil may cause the entire system to break down. Furthermore, contamination of the oil leads to considerable disturbances in the following hydraulic components of the system.

When such disturbances occur, they take place at varying depths in increasingly short time periods. They can only be eliminated when the apparatus is dismantled. This requires the entire boring rod system to be moved out of the borehole. The time period lost thereby and by moving the rods back in are unacceptable when they are more frequent than the time periods required for changing worn out boring tools.

The invention is based on the problem of simplifying the structure of the self-control means for a self-controlling drill rod having the features explained at the outset, and ensuring that the service life of the parts important to the system is at least great enough, independently of the pressure of the borehole fluid and thus of the depth of driven borings, to equal the service life of the boring tools.

According to the invention, the hydraulic differential pressure prevailing between the boring rod fluid in the flush channel of the drilling shaft and the borehole fluid at the particular end of the housing is utilized to prevent contaminated drilling fluid from passing out of the borehole into the housing, by branching off a partial current of the in-flowing fluid largely free from debris as the working medium of the hydraulic system. This differential pressure produces a pressure gradient from the annular space into the borehole, so that no debris can flow back. On the other hand, this pressure gradient is relatively small so that small pressure differences also prevail before and behind the check valves separating the clean borehole fluid from the contaminated borehole fluid, which considerably simplifies the structure of such valves.

The invention also utilizes the relatively clean boring rod fluid as the working fluid for the hydraulic system of the self-control means, which performs necessary work, for instance, in the drives of the control bars. This allows for the self-control means to be realized with a simplified hydraulic system even for very deep borings with accordingly high hydraulic pressures. The above-described rotary transmission leadthroughs are under the high hydraulic pressure of the fluid on the outside, and under the system pressure on the inside, resulting in small differential pressures in deep borings so that the soft seals can also be used here.

It has been shown that, in spite of the sensitive components of the hydraulic system of the self-control means, not only fluids consisting of water or gels are suitable as working fluids but also thixotrope muds, if they are separated from the borehole fluid and are therefore essentially free from debris. All types of fluids do acquire parts of the debris in the course of their use in the flushing cycle. But since the invention involves branching off a partial current of the fresh fluid, i.e., the boring rod fluid, into the annular space, dangerous contamination of the hydraulic working fluid can be counteracted. After the boring rods have been raised, the borehole fluid still stands in the borehole, but the fluid filling of the annular space can be maintained when the boring rods are being moved in and out by built-in check valves, thereby preventing debris from penetrating.

This also makes it possible to include the bearings in the boring rod fluid of the annular space and cool them with this fluid. The check valves have mainly a dirt-repellant effect on the debris of the borehole mud.

A further advance may be achieved by using the clean boring rod fluid to drive a pulse generator by generating the necessary pressure with a pump mechanically derived from the boring rods. This makes it possible to shape the pulses rendering the measured values in such a way they can be read off a differential pressure sensor at the borehole mouth without error.

The above-mentioned possibility of using boring rod fluids contaminated with particles of debris without any trouble in the inventive way as described above may be realized by providing a radial bore extending as far as the flush channel and having a filter built in which is acted on by the fluid from the flush channel, because suitable filters or filter media are available and have sufficient service lives, so that the regular removal of contaminated filters after the rods are raised to change the boring tool suffices to eliminate this source of trouble.

The check valves required at the ends of the housing or the annular space can be of relatively simple design. The valve body is formed by a metal ring placed in a groove in the vertical housing and biased with an annular spring assembly, for example, toward the valve seat which is placed in axially immovable fashion in a groove in the drilling shaft or a drilling shaft flange. Such metal rings are a known kind of seal and are suitable for rough operating conditions, like those occurring, for example, in construction engineering. They are particularly expedient as check valves for the purposes of the invention because their spring power is strengthened by the pressure of the borehole fluid applied on the outside and because the pressure gradient directed from the inside toward the outside prevents abrasive particles of the debris from coming between the metal ring surfaces projecting onto each other.

BRIEF DESCRIPTION OF THE DRAWINGS

FIG. 1 shows schematically and without the inventive details a total view of the self-controlling drill rod according to the invention in a longitudinal cross-section, FIG. 2 shows a section along line II—II of FIG. 1.

FIG. 4 shows an enlarged, detailed view of a section of the self-controlling drill rod of FIG. 1, with an arrow indicating the general area of FIG. 1 from which FIG. 4 is taken.

BRIEF DESCRIPTION OF THE PREFERRED EMBODIMENTS

Figure 3:
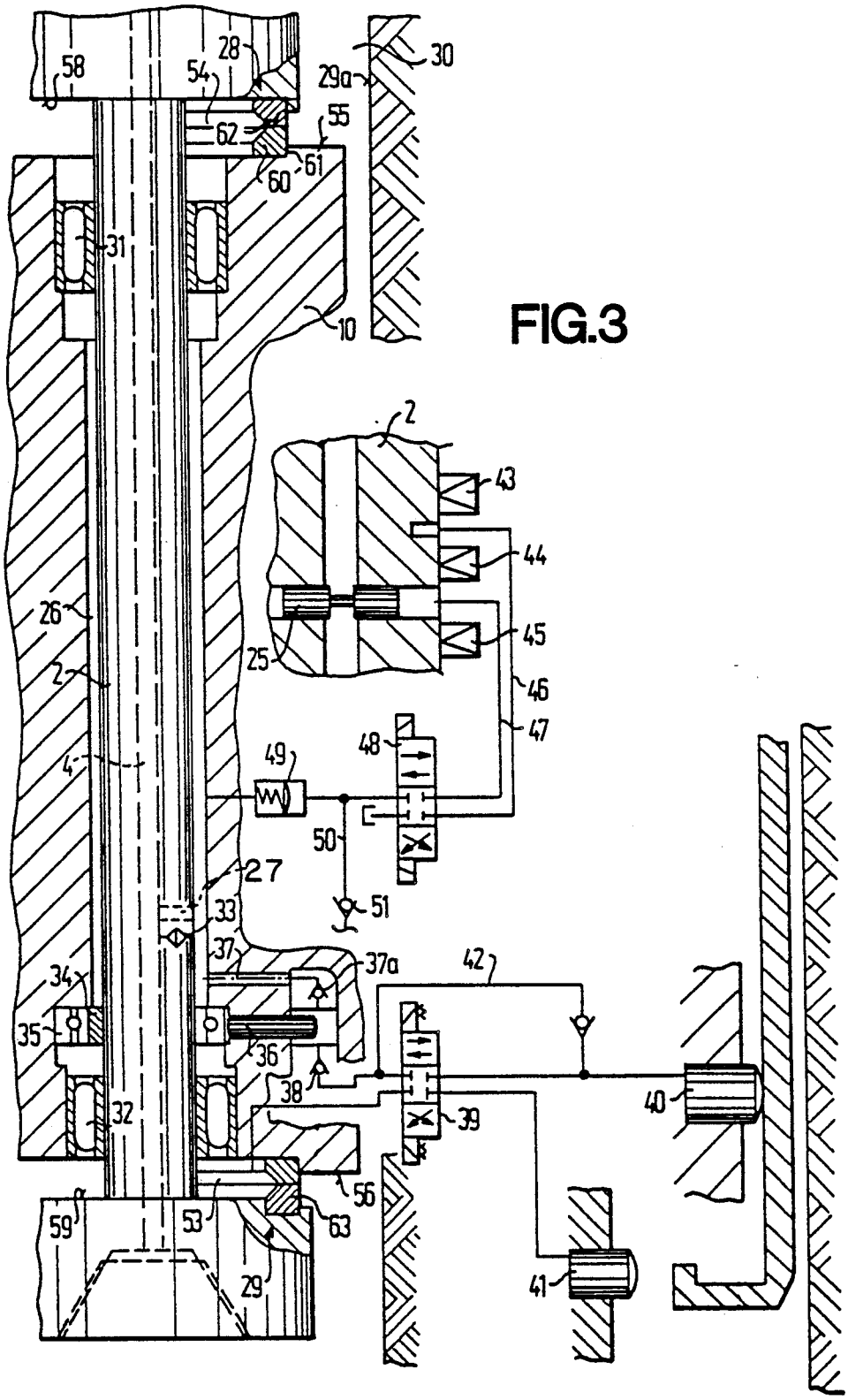
FIG. 3 shows schematically the design of the inventive self-control means, with parts represented in cross-section and the hydraulic system in symbols.

According to the view of FIG. 1, the self-controlling drill rod referred to in general as (1) is provided with a drilling shaft (2) which can be screwed onto the end of the last drill rod of rotary rods via a threaded head (3) customary for boring rods of rotary boring systems. Drilling shaft (2) has a flush channel (4) which extends as far as the other end (5) of the shaft of enlarged diameter which receives with its inside thread (6) the threaded stem (not shown) of a boring tool consisting of a plurality of tapered rollers equipped with hard-metal bits.

The drilling shaft is surround by a housing (10). On the outside of the housing, control bars (11–14) of U-shaped profile are mounted, each offset by a quarter circle, so as to swing out with their bent ends, as shown at (15) in FIG. 1. The housing has projections (16–19) enclosed by the U-shaped profiles of the control bars (11–14), chambers being formed in these projections. In the chamber shown at (20) in FIG. 1, the control electronics of the self-control means are provided in protected fashion. In the chamber (21) below, there are gradometers of crosswise orientation which indicate the actual values for the inclination of the boring rods in the borehole. The chamber (22) farther below contains the driving piston associated with each control bar. The rotor of a generator (22*a*) generating the electrical energy is connected so as to rotate with the drilling shaft (2) and operates in a stator which is stationary in the housing. A hydraulic pump is placed in the chamber marked at (24), while a hydraulic pulse generator is indicated at (25).

During operation, the control bars (11–14) are swung out in accordance with the signals coming from the gradometers at (21), thereby holding the drill rod (1) in the predetermined direction of boring. The electronics convert the measured values into electric or hydraulic signals which are converted by the distributing valves of the hydraulic system or picked up by the pulse generator. The latter changes the cross-section of the flush channel, thereby producing in the boring rod fluid differential pressures which are read at the borehole mouth and converted into digital values.

According to the view in FIG. 3, an annular space (26) surrounding the drilling shaft (2) is formed between the drilling shaft (2) and the housing (10). It is connected with the boring rod fluid with a radial shaft bore (27) extending from the annular space into the flush channel (4) of the drilling shaft (2). At each end, the annular space is sealed with a rotary check valve (28, 29) from the borehole fluid (30) flowing between the housing (10) and the borehole face (29*a*). The borehole fluid contains particles detached by the boring tool (not shown in FIG. 3). The radial bearings of the drilling shaft (2) shown schematically at (31 and 32) are located between the two rotary seals (28 and 29). The axial bearing usually provided is not shown in the view of FIG. 3 for the sake of simplicity. To show the hydraulic system, the dirt filter (33) built into the radial bore (27) is shown beside the bore.

In the hydraulic system of the self-control means, a hydraulic pump is associated with each bar. It is driven via an eccentric (34) which is attached so as to rotate with the drilling shaft (2) and acts via a ring bearing (35) on a pump plunger (36). A radial bore (37) connects the pressure chamber of the pump cylinder with the annular space (26) in which the clean boring rod fluid is standing. Check valves (37*a*, 38) protect the pressure chamber of the pump. The pump acts on an electrically driven, resiliently biased two/three way valve (39) which acts on the driving pistons mentioned in connection with FIG. 1, which are associated, as pivot drives, with opposite control bars and marked as (40 and 41). The hydrostatic system is protected by a bypass line (42) protected by a check valve.

In the central portion of FIG. 3, one can see the pulse generator (25) in the form of a double piston mounted in radially movable fashion in the drilling shaft (2). The soft seals of the rotary transmission leadthroughs (43–45) serve to protect the two hydraulic lines (46 and 47) which act on the piston of the pulse generator. This is effected via a two/three way valve (48) corresponding to the valve (39) and acted on by a spring pressure accumulator (49) with the clean fluid which is acted on by the hydraulic pressure generator via a branch line (50) and a pressure control valve (51).

As also indicated in FIG. 3, the check valves (28, 29) have a uniform design. They are also each seated according to the enlarged view in FIG. 4 in a radial gap (53, 54) between the face (55, 56) of the housing (10) and a collar (58, 59) of the drilling shaft (2). Each valve is realized by a slide ring (66) axially biased by a pressure spring (65) seated in a bore (64), said slide ring being housed in a groove (61) in the housing (10). The valve seat is provided by the annular surface (62) of a metal ring (63) which is fixed immovably in each collar (58, 59) of the drilling shaft (2) in a groove (67) provided there.

The ring surfaces projecting onto each other serve as dirt repellents due to the pressure gradient directed from the inside toward the outside. Due to the wedge shape of the sealing gap, the surface relations of the rings are selected such that the ring surfaces are raised from each other by the inside pressure prevailing in the annular space as soon as the inside pressure is greater than the outside pressure. Therefore, boring rod fluid can overcome the ring surfaces from the outside, but cannot flow back.

What is claimed is:

1. A self-controlling drill rod for rotary boring rods of machine rock drills of the type employing a rotating boring tool and drilling fluid, the drill rod comprising:
- a housing having an interior side and an exterior side;
- an inner drilling shaft mounted on said interior side of said housing and rotatable therein;
- means to connect said drilling shaft to the boring rods;
- said drilling shaft having a flush channel therein;
- a plurality of control bars disposed on the exterior side of said housing and being swingably displaceable therefrom;
- a control electronics system for controlling the operation of the drill rod and an electrical generator for generating electrical power mounted in said housing;
- said control electronics system receiving electrical power from said electrical power generator which is actuated by the rotation effected by the machine rock drill;
- a hydraulic system;
- said hydraulic system including an annular space between said drilling shaft and said housing;
- a plurality of hydrostatic drives in operative communication with said control bars to effect said swingable displacement;
- said hydrostatic drives being operatively connected to said control electronics system;
- said annular space communicating with said flush channel via a radial connection;
- a rotary check valve closing off each end of said annular space, said rotary check valve allowing fluid flow from the annular space to the exterior of the housing and preventing fluid flow in the opposite direction;
- said annular space being a tank containing fluid for said hydraulic system, said fluid being formed by the drilling fluid, wherein hydraulic working pressures are derived from said drilling fluid in said annular space for swingable displacement of the control bars.

2. A self-controlling drill rod as in claim 1, wherein said radial connection is a bore having a fluid filter mounted therein.

3. A self-controlling drill rod as in claim 1, wherein said check valves include a slide ring axially biased within a groove and an axially fixed ring held by a groove within said housing.

4. A self-controlling drill rod for rotary boring rods of machine rock drills of the type employing a rotating boring tool and drilling fluid, the drill rod comprising:

a housing having an interior side and an exterior side;

an inner drilling shaft mounted on said interior side of said housing and rotatable therein;

means to connect said drilling shaft to the boring rods;

said drilling shaft having a flush channel therein;

a plurality of control bars disposed on the exterior side of said housing and being swingably displaceable therefrom;

a control electronics system for controlling the operation of the drill rod and an electrical generator for generating electrical power mounted in said housing;

said control electronics system receiving electrical power from said electrical power generator which is actuated by the rotation effected by the machine rock drill;

a hydraulic system;

said hydraulic system including an annular space between said drilling shaft and said housing;

a plurality of hydrostatic drives in operative communication with said control bars to effect said swingable displacement;

said hydrostatic drives being operatively connected to said control electronics system;

said annular space communicating with said flush channel via a radial connection;

a rotary check valve closing off each end of said annular space, said rotary check valve allowing fluid flow from the annular space to the exterior of the housing and preventing fluid flow in the opposite direction;

said annular space being a tank containing fluid for said hydraulic system, said fluid being formed by the drilling fluid; and a pressure pulse generator with the drilling fluid serving as the hydraulic medium of the pressure pulse generator, wherein hydraulic working pressures are derived from said drilling fluid in said annular space for swingable displacement of the control bars and the operation of the pressure pulse generator.

5. A self-controlling drill rod as in claim 4, wherein said radial connection is a bore having a fluid filter mounted therein.

6. A self-controlling drill rod as in claim 4, wherein said check valves include a slide ring axially biased within a groove and an axially fixed ring held by a groove within said housing.

7. A self-controlling drill rod as in claim 4, wherein said pressure pulse generator is acted upon via a rotary transmission leadthrough provided with soft seals from an accumulator which is acted upon by a hydraulic pressure generator.

* * * * *